US009997109B2

(12) United States Patent
Wu

(10) Patent No.: US 9,997,109 B2
(45) Date of Patent: Jun. 12, 2018

(54) DISPLAY DEVICE WITH REDUCED NUMBER OF TRANSISTORS AND ITS DRIVING METHOD

(71) Applicant: Japan Display Inc., Tokyo (JP)

(72) Inventor: Ilin Wu, Tokyo (JP)

(73) Assignee: Japan Display Inc., Tokyo (JP)

( * ) Notice: Subject to any disclaimer, the term of this patent is extended or adjusted under 35 U.S.C. 154(b) by 29 days.

(21) Appl. No.: 15/249,919

(22) Filed: Aug. 29, 2016

(65) Prior Publication Data

US 2017/0178570 A1 Jun. 22, 2017

(30) Foreign Application Priority Data

Dec. 21, 2015 (JP) ..... 2015-248431

(51) Int. Cl.

*G09G 3/3258* (2016.01)
*G09G 3/3233* (2016.01)
*G09G 3/3266* (2016.01)
*G09G 3/3291* (2016.01)
(Continued)

(52) U.S. Cl.

CPC ..... *G09G 3/3258* (2013.01); *G09G 3/3233* (2013.01); *G09G 3/3266* (2013.01);
(Continued)

(58) Field of Classification Search

CPC .. G09G 3/3258; G09G 3/3291; G09G 3/3266; G09G 3/3233; G09G 2300/0819;
(Continued)

(56) References Cited

U.S. PATENT DOCUMENTS

2009/0273617 A1 11/2009 Tanikame et al.
2012/0075259 A1 3/2012 Chung
(Continued)

FOREIGN PATENT DOCUMENTS

JP 2015-049335 A 3/2015
TW 201001376 A 1/2010
(Continued)

OTHER PUBLICATIONS

Taiwanese Office Action dated Jun. 7, 2017, for the corresponding Taiwanese patent application No. 105125336.
(Continued)

*Primary Examiner* — Premal R Patel
(74) *Attorney, Agent, or Firm* — Typha IP LLC

(57) ABSTRACT

A display device including pixel circuit groups containing pixel circuits. The pixel circuit groups each contain: a first transistor whose first terminal is connected to a power source potential line; and a sixth transistor whose control terminal is connected to a first scanning signal line and whose first terminal is connected to an image signal line. The pixel circuit each include: a second transistor whose control terminal is connected to a first node and whose first terminal is connected to a second terminal of the first transistor and a second terminal of the sixth transistor; a third transistor whose first terminal is connected to the first node and whose second terminal is connected to a second terminal of the second transistor; a fourth transistor whose first terminal is connected to the second terminal of the second transistor; and a fifth transistor whose first terminal is connected to the first node.

13 Claims, 8 Drawing Sheets

(52) U.S. Cl.
CPC ... *G09G 3/3291* (2013.01); *G09G 2300/0439* (2013.01); *G09G 2300/0814* (2013.01); *G09G 2300/0819* (2013.01); *G09G 2300/0842* (2013.01); *G09G 2300/0861* (2013.01); *G09G 2310/0245* (2013.01); *G09G 2310/0251* (2013.01); *G09G 2310/08* (2013.01)

(58) Field of Classification Search
CPC ... G09G 2310/0251; G09G 2310/0245; G09G 2300/0861; G09G 2300/0842; G09G 2300/0814; G09G 2310/08; G09G 2300/0439
See application file for complete search history.

(56) References Cited

U.S. PATENT DOCUMENTS

| | | | | |
|---|---|---|---|---|
| 2014/0176520 | A1 | 6/2014 | Hwang et al. | |
| 2015/0062195 | A1 | 3/2015 | Kumeta et al. | |
| 2015/0310802 | A1 | 10/2015 | Guo et al. | |
| 2016/0275867 | A1* | 9/2016 | Kim | G09G 3/3258 |
| 2016/0335937 | A1* | 11/2016 | Lee | G09G 3/2003 |
| 2017/0053591 | A1* | 2/2017 | Seo | G09G 3/3225 |
| 2017/0076646 | A1* | 3/2017 | Gu | G09G 3/003 |
| 2017/0110048 | A1* | 4/2017 | Kim | G09G 3/325 |
| 2017/0124956 | A1* | 5/2017 | Yin | G09G 3/3291 |
| 2017/0169764 | A1* | 6/2017 | Lee | G09G 3/3233 |

FOREIGN PATENT DOCUMENTS

| | | | |
|---|---|---|---|
| TW | 201426705 | A | 7/2014 |
| TW | 201541444 | A | 11/2015 |

OTHER PUBLICATIONS

Taiwanese Office Action dated Feb. 9, 2017 for corresponding TW patent application No. 105125336, with full English translation.

* cited by examiner

DISPLAY DEVICE WITH REDUCED NUMBER OF TRANSISTORS AND ITS DRIVING METHOD

CROSS REFERENCE TO RELATED APPLICATIONS

This application is based on and claims the benefit of priority from the prior Japanese Patent Application No. 2015-248431, filed on Dec. 21, 2015, the entire contents of which are incorporate herein by reference.

FIELD

The invention relates to a display device. In particular, the invention relates to a display device in which a light-emitting element disposed in a pixel is subjected to a current-driving operation.

BACKGROUND

In an organic electroluminescence (hereinafter, referred to as organic EL) display device, a light-emitting element is disposed in each pixel, and an image is displayed by independently controlling emission of the pixels. A light-emitting element has a structure in which a layer (hereinafter, referred to as an emission layer) is sandwiched between a pair of electrodes, where one electrode as an anode is distinguished from the other electrode as a cathode. In an organic EL display device, one electrode is provided in every pixel as a pixel electrode, and the other electrode is provided as a common electrode which extends over a plurality of pixels and is applied with a common potential. In an organic EL display device, emission of the pixels is controlled by applying the pixel electrode with a potential corresponding to an image.

A driving transistor is connected to a light-emitting element disposed in each pixel of a display device. When these driving transistors have variation in a threshold voltage, the variation could influence the luminance of the display device, leading to a defective display. In order to compensate the defective display due to the variation of the threshold voltage of the driving transistors, a display device which undergoes threshold compensation of the driving transistors and its driving method are disclosed in patent document 1 (Japanese patent application publication No. 2015-049335).

SUMMARY

However, in this traditional technique, at least 6 transistors are required in one pixel in order to compensate the threshold voltage of the driving transistors. A circuit in which the number of transistors in one pixel is reduced is demanded to increase resolution of a display device.

In view of the aforementioned background, a purpose of the invention is to supply a display device using a circuit in which the number of transistors in one pixel is reduced.

An embodiment of the present invention is a display device comprising: a plurality of first scanning signal lines; a plurality of second scanning signal lines; a plurality of initialization-controlling signal lines; a plurality of emission-controlling signal lines; a plurality of image signal lines intersecting the plurality of first scanning signal lines, the plurality of second scanning signal lines, the plurality of initialization-controlling signal lines, or the plurality of emission-controlling signal lines; and a plurality of pixel circuit groups connected to any one of the plurality of first scanning signal lines, any one of the plurality of second scanning signal lines, any one of the plurality of initialization-controlling signal lines, and any one of the plurality of emission-controlling signal lines. Each of the plurality of pixel circuit groups comprises: a plurality of pixel circuits; a first transistor in which a control terminal is connected to the emission-controlling signal line and a first terminal is connected to the power source potential line; and a second transistor in which a control terminal is connected to the first scanning signal line and a first terminal is connected to the image signal line. Each of the plurality of pixel circuits comprises: a third transistor in which a control terminal is connected to a first node, and a first terminal is connected to a second terminal of the first transistor and a second terminal of the second transistor; a fourth transistor in which a first terminal is connected to the first node, a second terminal is connected to a second terminal of the third transistor, and a control terminal is connected to the second scanning signal line; a fifth transistor in which a first terminal is connected to a second terminal of the second transistor, and a control terminal is connected to the emission-controlling signal line; a sixth transistor in which a first terminal is connected to the first node, a control terminal is connected to the initialization-controlling signal line, and a second terminal is connected to an initialization signal line; a storage capacitor in which a first terminal is connected to the first node; and a light-emitting element connected to a second terminal of the fifth transistor.

DESCRIPTION OF EMBODIMENTS

Figure 1:
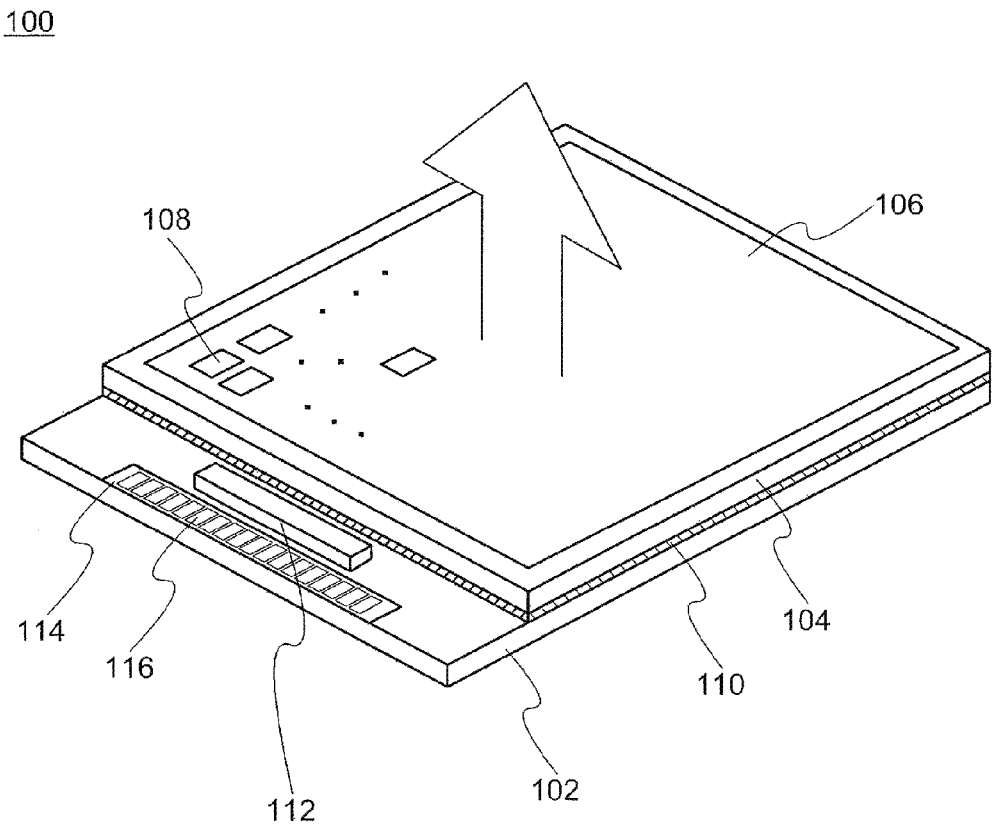
FIG. 1 is a perspective view for explanation of an outline structure of a display device according to an embodiment of the present invention.

Hereinafter, the embodiments of the present invention are explained with reference to the drawings. However, the invention can be implemented in a variety of different modes and should not be interpreted only within the disclosure of the embodiments exemplified below. Furthermore, in the drawings, the width, thickness, shape, and the like are illustrated more schematically compared with those of the actual modes in order to provide a clearer explanation. However, they are only an example, and do not limit the interpretation of the invention. Additionally, in the specification and the drawings, the same reference number is provided to an element that is the same as that appearing in preceding drawings, and the detailed explanation might be omitted as appropriate.

First Embodiment

A structure of a display device 100 according to the present embodiment and its driving method are explained using the drawings.

<Outline Structure>

FIG. 1 is a perspective view explaining an outline structure of the display device 100 according to the present embodiment. The display device 100 according to the present embodiment has a first substrate 102, a second substrate 104, a plurality of pixels 108, a sealing material 110, a terminal region 114, and a connection terminal 116.

Over the first substrate 102 is provided a display region 106. In the display region 106, a plurality of pixels 108 each of which has at least one light-emitting element is arranged over the first substrate 102.

Over a top surface of the display region 106 is disposed the second substrate 104 which opposes the first substrate 102. The second substrate 104 is fixed to the first substrate 102 with the sealing material 110 which surrounds the display region 106. The display region 106 formed over the first substrate 102 is sealed with the second substrate 104 and the sealing material 110 to avoid exposure to air. Such a sealing structure suppresses degradation of the light-emitting elements disposed in the pixels 108.

The terminal region 114 is provided to one edge portion of the first substrate 102. The terminal region 114 is arranged outside the second substrate 104. The terminal region 114 is structured with the plurality of connection terminals 116. On the connection terminals 116 is arranged a wiring substrate which connects a device outputting image signals, a power source, and the like to a display panel (the display device 100 in FIG. 1). Connection positions of the connection terminals 116, which are connected to the wiring substrate, are exposed outside. On the first substrate 102 is disposed a driver IC 112 which outputs the image signals input from the connection terminal 116 to the display region 106.

<Circuit Structure>

Figure 2:
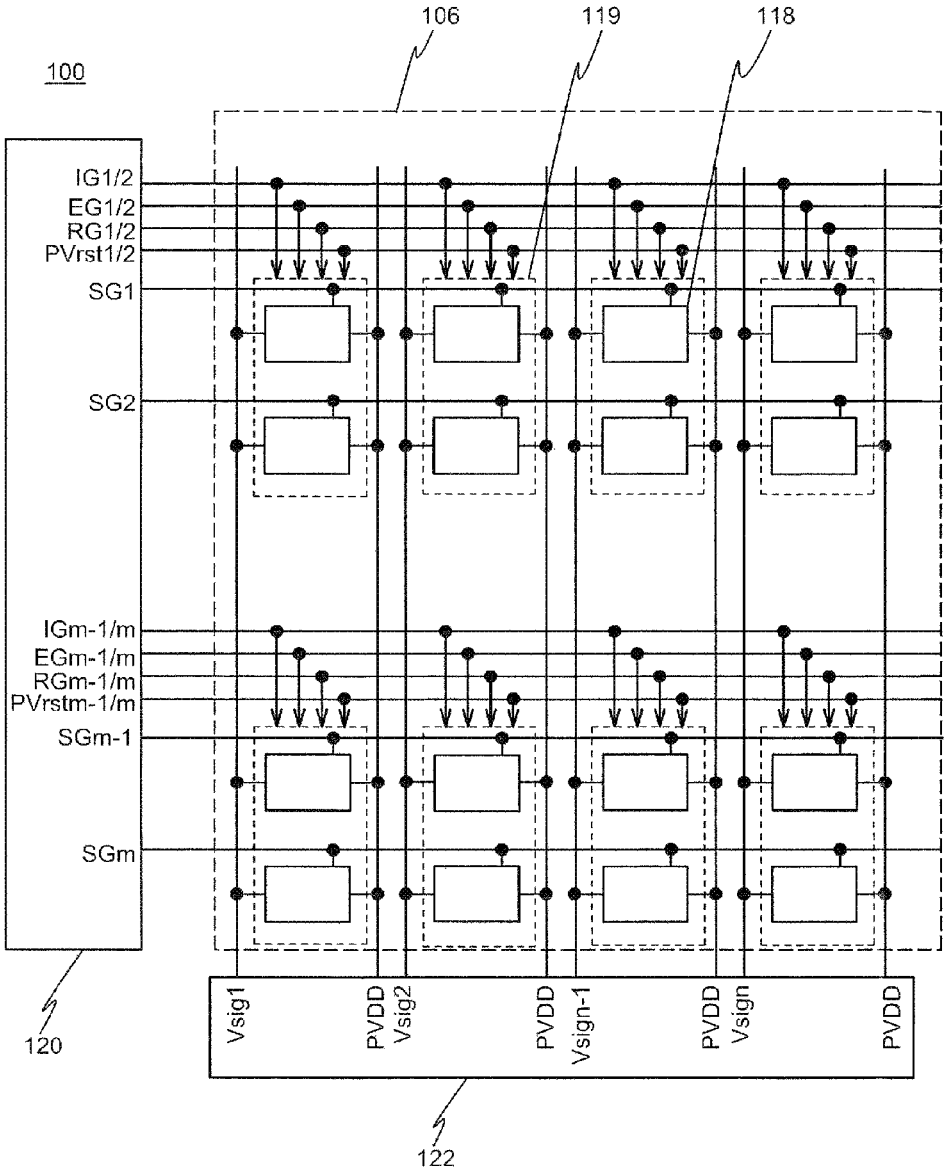
FIG. 2 is a drawing of a circuit for explanation of a circuit structure of a display device according to an embodiment of the present invention.

FIG. 2 is a drawing of a circuit for explanation of a circuit structure of the display device 100 according to the present embodiment.

The display device 100 according to the present embodiment has a plurality of pixel circuit groups 119, a scanning line driver circuit 120, and a signal line driver circuit 122. The display device 100 further includes a plurality of first scanning lines IG, a plurality of second scanning signal lines SG, a plurality of initialization-controlling signal lines RG, a plurality of emission-controlling signal lines EG, a plurality of initialization signal lines PVrst, a plurality of image signal lines Vsig, and a plurality of power source potential lines PVDD.

The scanning line driver circuit 120 respectively outputs signals IG1/2 to IGm-1/*m* to the plurality of first scanning signal lines IG, signals SG1 to SGm to the plurality of second scanning signal lines SG, signals RG1/2 to RGm-1/*m* to the plurality of initialization-controlling signal lines RG, signals EG1/2 to EGm-1/*m* to the plurality of emission-controlling signal lines EG, and signals Vrst1/2 to Vrstm-1/*m* to the plurality of the initialization signal lines PVrst.

The signal line driver circuit 122 outputs image signals Vsig1 to Vsign to the plurality of image signal lines Vsig. Furthermore, the signal line driver circuit 122 may output the power source potential PVDD to the plurality of power source potential lines PVDD as illustrated. The plurality of image signal lines Vsig and the plurality of power source potential lines PVDD are arranged so as to intersect the plurality of scanning signal lines SG, the plurality of initialization-controlling signal lines RG, and the plurality of emission-controlling signal lines EG.

Note that, in the embodiment, a mode is shown in which the signals Vrst1/2 to Vrstm-1/*m* are output to the plurality of initialization signal lines PVrst, respectively, from the scanning driver circuit 120. However, the invention is not limited thereto, and the embodiment may have a structure in which signals Vrst1 to Vrstn are output to the plurality of initialization signal lines PVrst, respectively, from the signal line driver circuit 122.

Each of the pixel circuit groups 119 includes a plurality of pixel circuits 118. In the embodiment, each of the plurality of pixel circuit groups 119 includes two pixel circuits (first pixel circuit 118A and second pixel circuit 118B). Furthermore, the plurality of pixel circuit groups 119 is arranged in a matrix form in the display region 106 of the display device 100. Additionally, each of the plurality of pixel circuit groups 119 is connected to any one of the plurality of the first scanning signal lines IG and any one of the plurality of image signal lines Vsig. Moreover, each of the plurality of pixel circuit groups 119 is connected to any one of the plurality of initialization-controlling signal lines RG, any one of the plurality of emission-controlling signal lines EG, any one of the plurality of initialization signal lines pVrst, and any one of the plurality of power source potential lines PVDD. Although the arrangement of the plurality of pixel circuit groups 119 is not limited to a matrix form, explanation is provided for the arrangement of a matrix form having m/2 lines and n columns (m and n each are an integral number, and m is an even number).

Next, a circuit structure of each of the plurality of pixel circuit groups 119 included in the display device 100 according to the embodiment is explained in detail.

Note that each of the pixel circuit groups 119 includes a plurality of transistors, and a gate terminal of a transistor may be called a control terminal in the following explanation. Furthermore, for convenience, one of a source terminal and a drain terminal of a transistor may be called a first terminal, and the other may be called a second terminal. That is, a first terminal of a transistor may function as a source terminal or a drain terminal according to the conditions in applying a voltage. With respect to a second terminal, a similar explanation is given.

Figure 3:
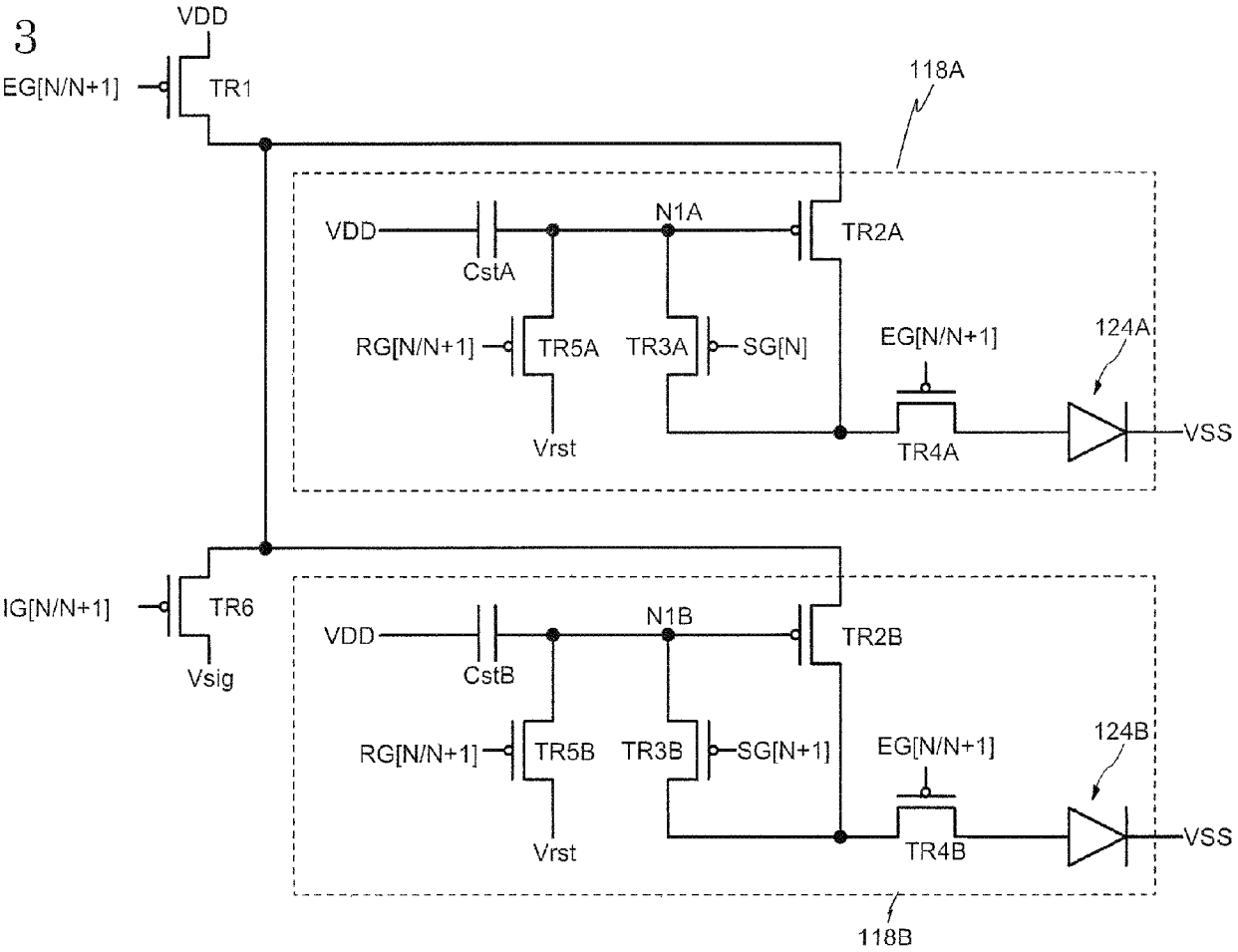
FIG. 3 is a drawing for explanation of a circuit structure of a plurality of pixel circuit groups included in a display device according to an embodiment of the present invention.

FIG. 3 is a drawing explaining a circuit structure of each of the plurality of pixel circuit groups 119 included in the display device 100 according to the embodiment. Each of the plurality of pixel circuit groups 119 included in the display device 100 according to the embodiment includes a first transistor TR1, a sixth transistor TR6, and a plurality of pixel circuits 118. In the embodiment, each of the plurality of pixel circuit groups 119 includes two pixel circuits (first pixel circuit 118A and second pixel circuit 118B).

With respect to the first transistor TR1, a control terminal is connected to the emission-controlling signal line EG. Furthermore, a first terminal is connected to the power source potential line PVDD, and a second terminal is connected to the first pixel circuit 118A and the second pixel circuit 118B included in the pixel circuit group 119.

With respect to the sixth transistor TR6, a control terminal is connected to the first scanning signal line IG. Furthermore, a first terminal is connected to the image signal line Vsig, and a second terminal is connected to the first pixel circuit 118A and the second pixel circuit 118B included in the pixel circuit group 119.

A circuit structure of each of the plurality of pixel circuits 118 included in each of the plurality of pixel circuit groups 119 is explained. Each of the plurality of pixel circuits 118 included in each of the plurality of pixel circuit groups 119 includes second to fifth transistors TR2 to TR5, a storage capacitor Cst, and a light-emitting element 124. Although one pixel circuit group 119 contains two pixel circuits of the first pixel circuit 118A and the second pixel circuit 118B in the embodiment, the circuit structure of the first pixel circuit 118A is specifically explained hereinafter because the circuit structures thereof are the same.

With respect to the second transistor TR2A, a control terminal is connected to a first node N1A, and a first terminal is connected to the second terminal of the first transistor TR1 and the second terminal of the sixth transistor TR6. The second transistor TR2 functions as a so-called driving transistor and supplies the light-emitting element 124A with a current corresponding to a potential applied to the control terminal. Furthermore, when the display device 100 is operated, the second transistor TR2 is driven in a saturated state.

With respect to the third transistor TR3A, a control terminal is connected to the second scanning signal line SG. Furthermore, a first terminal is connected to the first node N1A, and a second terminal is connected to a second terminal of the second transistor TR2A. When the third transistor TR3A is turned on according to the potential of the second scanning signal line SG, the second transistor TR2A exists in a diode connection state due to the conduction between the control terminal and the second terminal.

With respect to the fourth transistor TR4A, a control terminal is connected to the emission-controlling signal line EG. Furthermore, a first terminal is connected to the second terminal of the second transistor TR2A and the second terminal of the third transistor TR3A. Control of the potential of the emission-controlling line EG to turn on both the first transistor TR1 and the fourth transistor TR4A allows current to be supplied to the light-emitting element 124A, leading to an emission state.

With respect to the fifth transistor TR5A, a control terminal is connected to the initialization-controlling signal line RG. Furthermore, a first terminal is connected to the first node N1A, and an initialization signal Vrst is input from the initialization signal line PVrst to a second terminal.

With respect to the storage capacitor CstA, a first terminal is connected to the first node N1A, and a second terminal is connected to the initialization-controlling signal line RG.

With respect to light-emitting element 124A, an anode is connected to a second terminal of the fourth transistor TR4A, and a cathode is connected to a common potential line PVSS. As the light-emitting element 124A, a current-drive type light emitting element which emits light at a luminance depending on a supplied current can be used. In the embodiment, an organic light-emitting diode is used as the light-emitting element 124A.

Note that, in the embodiment, the first to sixth transistors TR1, TR2A to TR5A, and TR6 are P-channel transistors. However, they are not limited thereto, and any one of or all of the first to sixth transistors TR1, TR2A to TR5A, and TR6 may be N-channel transistors. That is, the first to sixth transistors TR1, TR2A to TR5A, and TR6 are transistors having the same polarity. Note that, when all of the transistors are N-channel transistors, the connection relationship of the circuit may be appropriately modified because the relationship between the source and drain is interchanged.

As described above, the circuit structure of each of the plurality of pixel circuits 118 included in the display device 100 according to the embodiment was explained. In the embodiment, the circuit structure includes 5 transistors and 1 capacitor in every one pixel. In the traditional technology, at least 6 transistors are necessary for one pixel in order to compensate the threshold voltage of a driving transistor.

According to the driving method of the display device described below in detail, the threshold compensation can be accomplished in the display device with the aforementioned structure. That is, as the number of the transistors included in one pixel can be reduced compared with that of the display devices according to the traditional technology, it is possible to further increase resolution of a display device.

<Driving Method>

The driving method of the display device 100 according to the embodiment is explained by using drawings.

Figure 4:
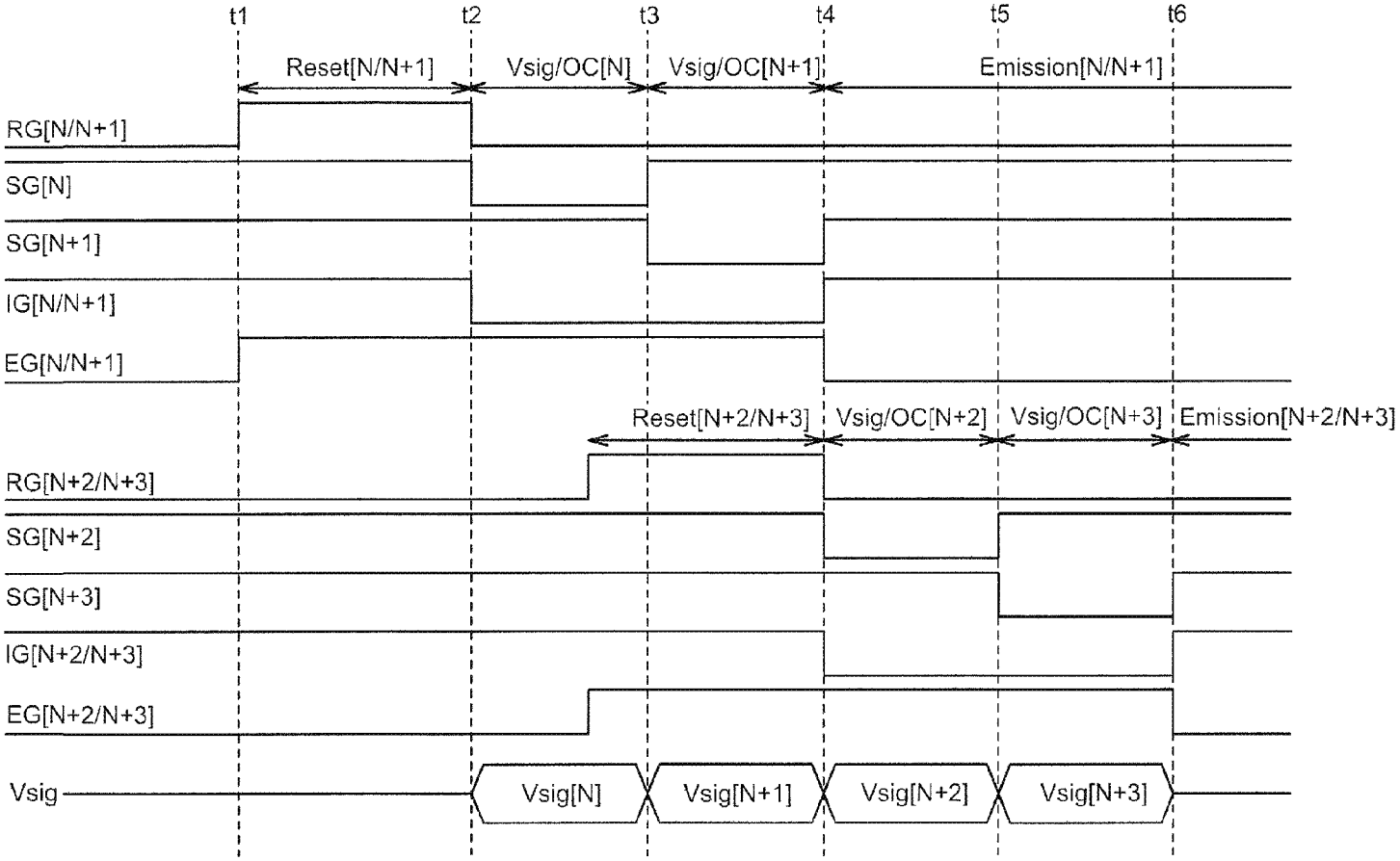
FIG. 4 is a timing chart for explanation of a driving method of a display device according to an embodiment of the present invention.

FIG. 4 is a timing chart for the explanation of the driving method of the display device 100 according to the embodiment. In FIG. 4, a timing chart of the pixel circuit group 119*a* including the first pixel circuit 118A disposed in the Nth line and the second pixel circuit 118B disposed in the N+1th line and the pixel circuit group 119*b* including the first pixel circuit 118A disposed in the N+2th line and the second pixel circuit 118B disposed in the N+3th line among the pixel circuit groups 119 arranged in a matrix form is shown.

The display device 100 according to the embodiment is driven so that three periods including an initialization period, a writing and threshold compensation period, and an emission period are included in one frame.

Figure 5:
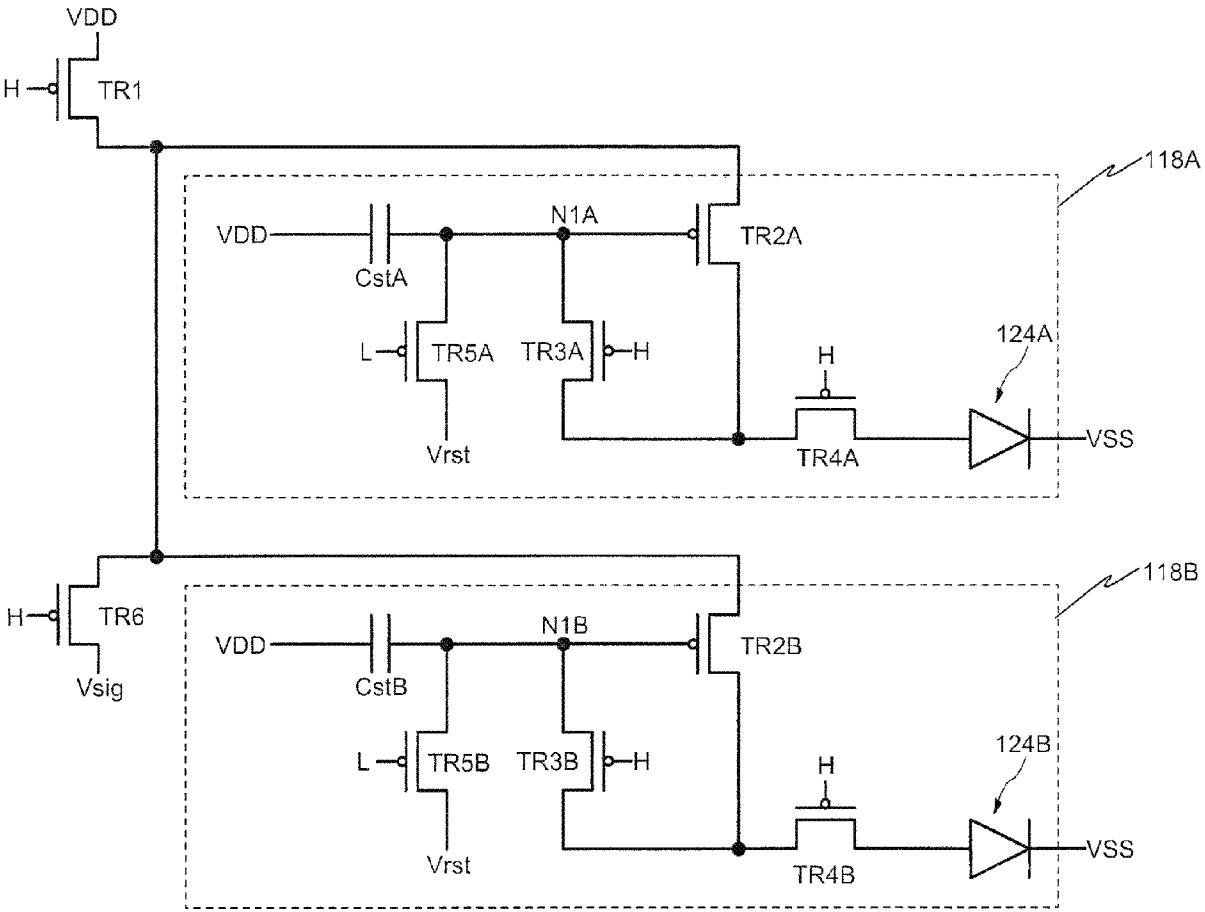
FIG. 5 is a drawing of a circuit for explanation of an operation of an initialization period of a display device according to an embodiment of the present invention.

First, driving in the initialization period is explained. As the first pixel circuit 118A and the second pixel circuit 118B included in the same pixel circuit group 119 are driven in the same way in the initialization period, driving of the first pixel circuit 118A is specifically explained. A period from time t1 to time t2 is the initialization period (Reset [N/N+1]) of the pixel circuit group 119*a* in which the first pixel circuit 118A and the second pixel circuit 118B are initialized at the same time. FIG. 5 is a drawing of a circuit for the explanation of the operation of the display device 100 according to the invention in the initialization period. Because a charge corresponding to the graduation data of the preceding frame is accumulated at the first node N1A just before the initialization period, this charge is discharged before writing the graduation data of the following frame in the initialization period.

Before entering the initialization period, a signal which turns off the third transistor TR3A is supplied to the control terminal of the third transistor TR3A. A high level (H) potential is applied to the control terminal of the third transistor to turn off the third transistor TR3A because the third transistor TR3A is a P-channel transistor in the embodiment.

Upon entering the initialization period at time t1, the first transistor TR1 and the fourth transistor TR4A are turned off. The high level (H) potential is applied to the control terminals of the first transistor TR1 and the fourth transistor TR4A to turn off the first transistor TR1 and the fourth transistor TR4A because the first transistor TR1 and the fourth transistor TR4A are P-channel transistors.

Upon entering the initialization period at time t1 in this state, a signal which turns on the fifth transistor TR5A is applied to the control terminal of the fifth transistor TR5A. The fifth transistor TR5A is turned on by applying a low level (L) potential to the control terminal of the fifth transistor TR5A because the fifth transistor TR5A is a P-channel transistor.

By this operation, the charge accumulated at the first node N1A in the preceding frame can be discharged through the fifth transistor TR5A.

The charge accumulated at the first node N1A in the preceding frame is discharged by the operation in the initialization period. At this time, the first node N1A is set at the potential of the initialization signal Vrst. The image data written from the storage capacitor CstA in the preceding frame is initialized by this discharge.

When the initialization period ends, the operation enters the writing and threshold compensation period. This operation is independently performed on the first pixel circuit 118A and the second pixel circuit 118B included in each of the pixel circuit groups 119. The period from time t2 to t3 is the writing and threshold compensation period (Vsig/OC[N]) of the first pixel circuit 118A, while the period from time t3 to t4 is the writing and threshold compensation period (Vsig/OC[N+1]) of the second pixel circuit 118B. In the writing and threshold compensation period, the graduation data is written and the threshold compensation of the second transistors TR2A and TR2B functioning as a driving transistor are performed in each of the pixel circuits 118.

Figure 6:
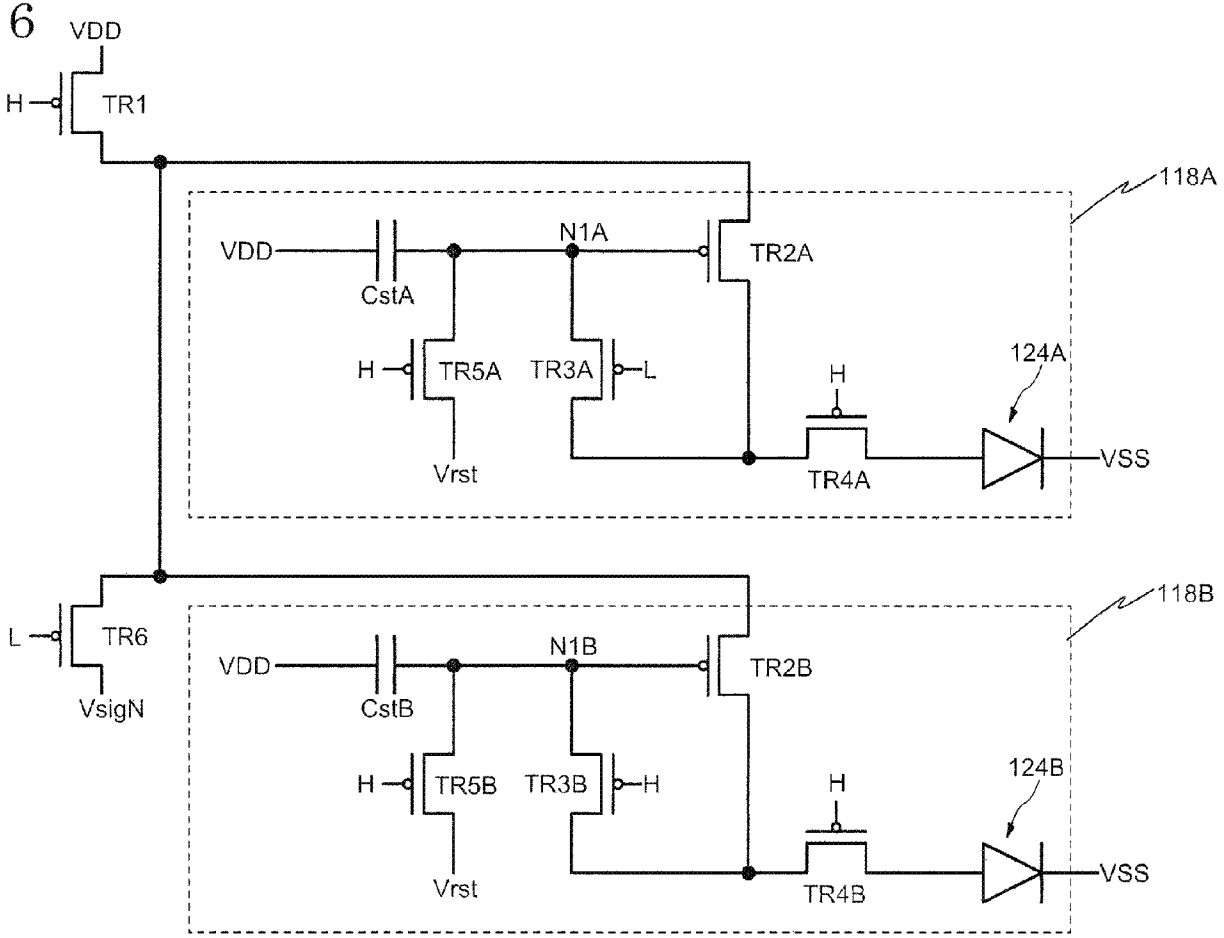
FIG. 6 is a drawing of a circuit for explanation of an operation of a writing and threshold compensation period of a display device according to an embodiment of the present invention.
Figure 7:
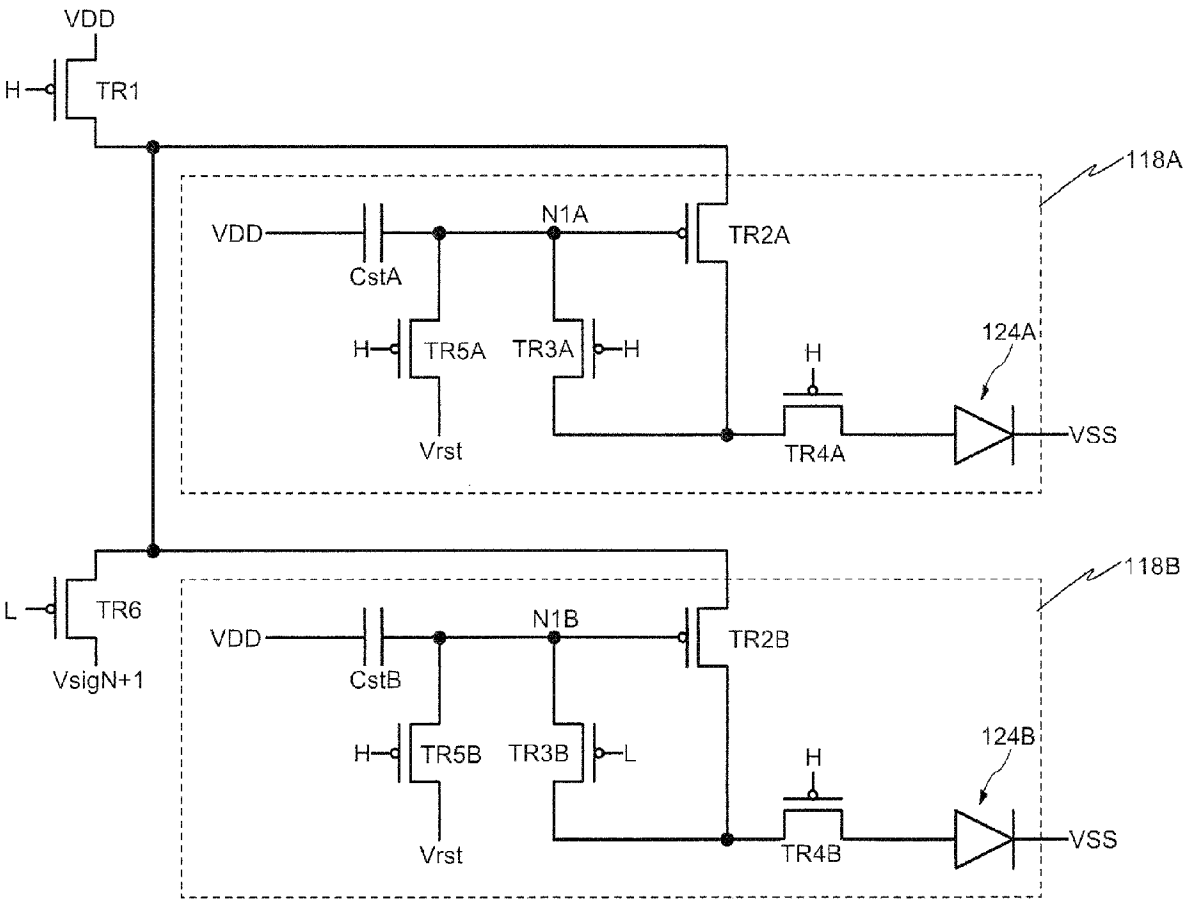
FIG. 7 is a drawing of a circuit for explanation of an operation of a writing and threshold compensation period of a display device according to an embodiment of the present invention.

FIG. 6 and FIG. 7 are drawings for the explanation of the operation of the display device 100 according to the embodiment in the writing and threshold compensation period.

At time t2, a signal which turns off the fifth transistor TR5A is applied to the control terminals of the fifth transistors TR5A and TR5B. The high level (H) potential is applied to the control terminals of the fifth transistors TR5A and TR5B to turn off the fifth transistors TR5A and TR5B because the fifth transistors TR5A and TR5B are P-channel transistors in the embodiment.

Additionally, at time t2, a signal which turns on the sixth transistor TR6 is applied to the first scanning signal line IG. The sixth transistor TR6 is turned on by adjusting the potential of the first scanning signal line IG at the low level because the sixth transistor TR6 is a P-channel transistor in the embodiment.

The third transistors TR3 of the plurality of pixel circuits 118 are sequentially turned on in this state to supply the graduation data to the image signal line Vsig, by which the graduation data and the information regarding the threshold of the second transistor TR2A are written at the first node N1A.

In the example shown in FIG. 4, the third transistor TR3A is turned on by adjusting the second scanning line SG[N] at the low level in the period from time t2 to time t3, by which the graduation data and the information of the threshold of the second transistor TR2A are written to the first pixel circuit 118A. Then, the second scanning line SG[N+1] is adjusted at the low level to turn on the third transistor TR3B in the period from time t3 to time t4, by which the graduation data and the information of the threshold of the second transistor TR2B are written to the second pixel circuit 118B.

Here, the graduation data and the information of the threshold of the second transistor TR2B are explained. When Vsig[N] is output to the image signal line Vsig in the writing and threshold compensation period of the first pixel circuit 118A, a potential Vsig[N]+Vth2A, which is a potential obtained by adding the threshold Vth2A of the second transistor TR2A to Vsig[N] is output on the second terminal side of the second transistor TR2A. That is, a potential of Vsig[N]+Vth2A is output to the first node N1A.

On the other hand, this period from time t2 to time t4 also includes the initialization period (Reset[N+2/N+3]) of the pixel circuit group 119*b*. In the embodiment, a mode is shown in which the initialization period (Reset[N+2/N+3]) is started within the period from time t2 to time t3 and ended at time t4. However, the timing of the initialization period (Reset[N+2/N+3]) is not limited to this timing. For example, the initialization period (Reset[N+2/N+3]) may be started within the period from time t3 to time t4 and ended at time t4, because the initialization period (Reset[N+2/N+3]) only requires a time sufficient for the discharge of the charge accumulated at the first node N1. That is, the initialization period (Reset[N+2/N+3]) only needs to overlap with the writing and threshold compensation period (Vsig/OC[N+1]) of at least the second pixel circuit 1186 of the pixel circuit group 119*a*.

Such a driving method allows the pixel circuits 118 of each of the lines to be sequentially driven and facilitates sufficiently securing the initialization period and the writing and threshold compensation period of each line.

The writing and threshold compensation period is followed by the emission period. The period after time t4 is the emission period of the pixel circuit group 119*a* in which the light-emitting elements 124A and 1246 simultaneously emit light. As the first pixel circuit 118A and the second pixel circuit 1186 included in the same pixel circuit group 119 are driven in the same way in the emission period, the driving of the first pixel circuit 118A is explained specifically.

Figure 8:
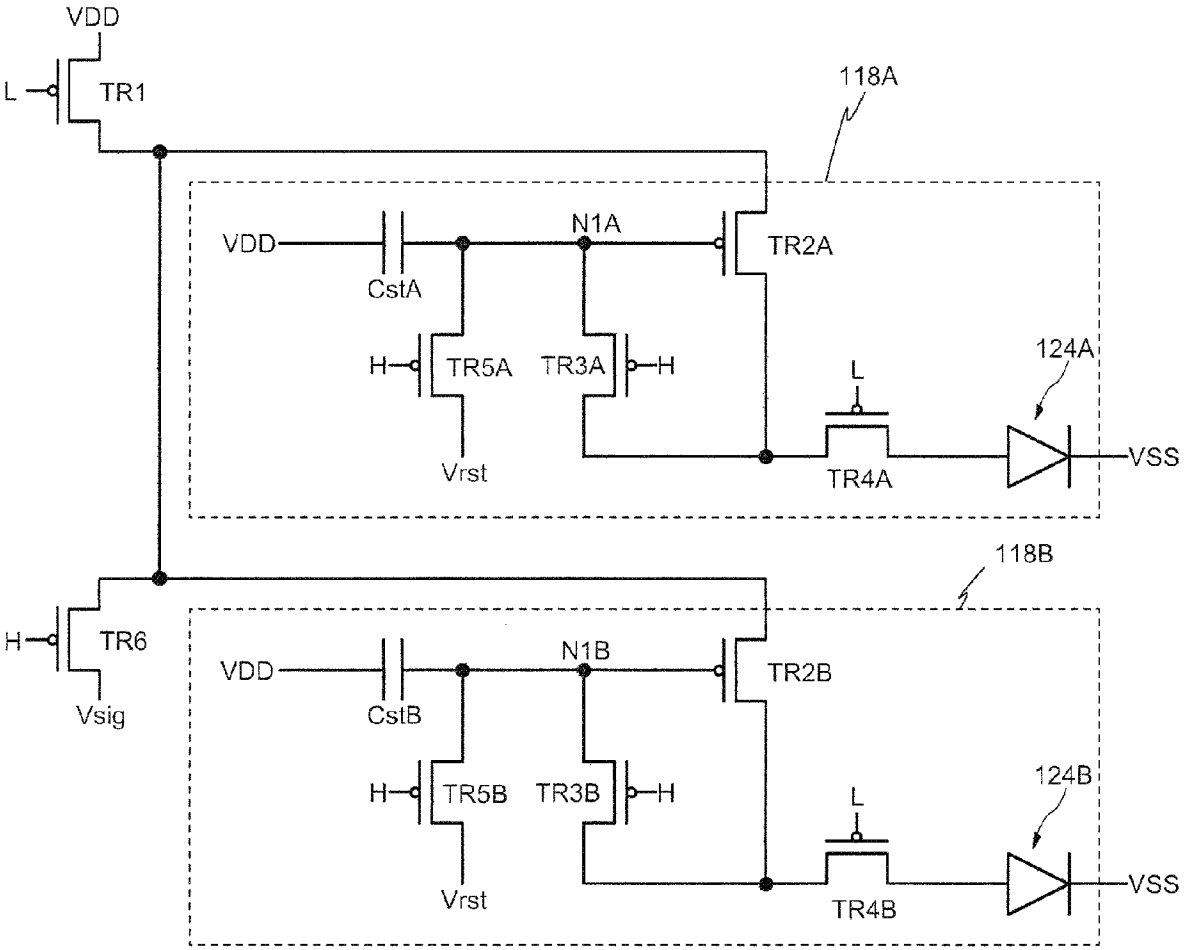
FIG. 8 is a drawing of a circuit for explanation of an operation of an emission period of a display device according to an embodiment of the present invention.

FIG. 8 is a drawing of the circuit for the explanation of the operation of the display device 100 according to the embodiment in the emission period. Signals which turn off the third transistor TR3A and the sixth transistor TR6 are supplied to the second scanning signal line SG and the first scanning signal line IG, respectively, at time t4. As the third transistor TR3A and the sixth transistor TR6 are P-channel transistors in the embodiment, the third transistor TR3A and the sixth transistor TR6 are turned off by adjusting the potentials of the second scanning signal line SG and the first scanning signal line IG at the high level.

In this state, the first transistor TR1 and the fourth transistor TR4A are turned on. As the first transistor TR1 and the fourth transistor TR4A are P-channel transistors in the embodiment, the first transistor TR1 and the fourth transistor TR4A are turned off by adjusting the potential of the emission-controlling signal line EG at the low level, by which current flows in the light-emitting element 124A and light is emitted.

The potential of the control terminal of the second transistor TR2A is maintained at Vsig[N]+Vth2A in the emission period. Application of this potential to the control terminal of the second transistor TR2A allows the generation of a driving current from which the influence of the threshold of the second transistor TR2A is excluded because the current of the second transistor TR2A in a saturated region is proportional to a square of (Vsig[N]−PVDD). Thus, the defective display caused by the variation of the threshold of the second transistor TR2 included in each pixel circuit can be excluded.

On the other hand, the writing and threshold compensation period (Vsig/OC[N+2]) of the pixel circuit group 119*b* is started at time t4. That is, the writing and threshold compensation period (Vsig/OC[N+2] and Vsig/OC[N+3]) of the pixel circuit group 119*b* overlaps with the emission period (Emission[N/N+1]) of the pixel circuit group 119*a*. The writing and threshold compensation period (Vsig/OC

[N+3]) of the pixel circuit group 119*b* starts at time t5, while the emission period of the pixel circuit group 119*b* starts at time t6 which is later than time t5.

This driving method allows the pixel circuit 118 in each line to be driven sequentially and facilitates sufficiently securing the initialization period and the writing and threshold compensation period of each line.

As described above, the structure and the driving method of the display device 100 according to the embodiment were explained. The number of the transistors included in one pixel can be decreased to 5 in the display device according to the embodiment compared with that according to the traditional technology. Furthermore, according to the driving method of the display device according to the embodiment, it is possible to compensate the threshold of the second transistor TR2 which functions as a driving transistor. Therefore, further increase in resolution of a display device can be achieved.

In the embodiment, an example is explained in which one pixel circuit group 119 includes two pixel circuits 118. However, the present invention is not limited to this structure and can be expanded to the case where one pixel circuit group 119 contains three or more pixel circuits 118.

What is claimed is:

1. A display device comprising:

a plurality of first scanning signal lines;

a plurality of second scanning signal lines;

a plurality of initialization-controlling signal lines;

a plurality of emission-controlling signal lines;

a plurality of image signal lines intersecting the plurality of first scanning signal lines, the plurality of second scanning signal lines, the plurality of initialization-controlling signal lines, or the plurality of emission-controlling signal lines; and a plurality of pixel circuit groups electrically connected to any one of the plurality of first scanning signal lines, any one of the plurality of second scanning signal lines, any one of the plurality of initialization-controlling signal lines, and any one of the plurality of emission-controlling signal lines, wherein each of the plurality of pixel circuit groups comprises:

a plurality of pixel circuits;

a first transistor in which a control terminal is electrically connected to the emission-controlling signal line and a first terminal is electrically connected to a power source potential line; and a sixth transistor in which a control terminal is electrically connected to the first scanning signal line and a first terminal is electrically connected to the image signal line, wherein each of the plurality of pixel circuits comprises:

a second transistor in which a control terminal is electrically connected to a first node, and a first terminal is electrically connected to a second terminal of the first transistor and a second terminal of the sixth transistor;

a third transistor in which a first terminal is electrically connected to the first node, a second terminal is electrically connected to a second terminal of the second transistor, and a control terminal is electrically connected to the second scanning signal line;

a fourth transistor in which a first terminal is electrically connected to a second terminal of the sixth transistor, and a control terminal is electrically connected to the emission-controlling signal line;

a fifth transistor in which a first terminal is electrically connected to the first node, a control terminal is electrically connected to the initialization-controlling signal line, and a second terminal is electrically connected to an initialization signal line;

a storage capacitor in which a first terminal is electrically connected to the first node; and a light-emitting element electrically connected to a second terminal of the fourth transistor, and wherein each of the plurality of pixel circuit groups is configured so that, in an initialization period:

a signal which turns off the third transistor is supplied to the control terminal of the third transistor; and a signal which turns on the fifth transistor is supplied to the control terminal of the fifth transistor.

2. The display device according to claim 1, wherein a second terminal of the storage capacitor is electrically connected to a constant potential.

3. The display device according to claim 1, wherein each of the plurality of pixel circuit groups is configured so that, in a writing and threshold compensation period after the initialization period:

a signal which turns off the fifth transistor is supplied to the control terminal of the fifth transistor; and gradation data is supplied to the image signal line by sequentially turning on the third transistors of the plurality of pixel circuits while supplying the plurality of second scanning signal line with a signal which turns on the sixth transistor.

4. The display device according to claim 3, wherein each of the plurality of pixel circuit groups is configured so that, in an emission period after the writing and threshold compensation period:

the first transistor and the fourth transistor are turned off while supplying the plurality of first scanning signal lines and the plurality of second scanning lines with signals which turn off the sixth transistor and the third transistor; and a current is flowed in the light-emitting elements to emit light.

5. The display device according to claim 4, wherein the first transistor, the second transistor, the third transistor, the fourth transistor, the fifth transistor, and the sixth transistor are P-channel transistors.

6. The display device according to claim 1, wherein the first transistor, the second transistor, the third transistor, the fourth transistor, the fifth transistor, and the sixth transistor are transistors with the same polarity.

7. A driving method of a display device which includes:

a plurality of pixel circuit groups each comprising:

a first pixel circuit;

a second pixel circuit; and first and sixth transistors each comprising a first terminal, a second terminal, and a control terminal;

wherein the first pixel circuit and the second pixel circuit in each of the plurality of pixel circuit groups comprise:

a second transistor, a third transistor, a fourth transistor, and a fifth transistor each comprising a control terminal, a first terminal, and a second terminal;

a storage capacitor comprising first and second terminals; and a light-emitting element; and wherein, in each of the plurality of pixel circuit groups:

the second terminal of the first transistor is electrically connected to the second terminal of the sixth transistor and the first terminal of the second transistor;

the control terminal of the second transistor is electrically connected to the first terminal of the third transistor, the first terminal of the fifth transistor, and the first terminal of the storage capacitor, and the second terminal of the second transistor is electrically connected to the second terminal of the third transistor and the first terminal of the fourth transistor; and the second terminal of the fourth transistor is electrically connected to the light emitting element, the driving method comprising:

turning off the third transistors and turning on the fifth transistors in a first period; and turning off the fifth transistors and supplying gradation data to the control terminals of the second transistors by sequentially turning on the third transistors of the plurality of pixel circuit groups while turning on the sixth transistors in a second period after the first period.

8. The driving method according to claim 7, further comprising, in a third period after the second period:

turning on the first transistors and the fourth transistors while turning off the sixth transistors and the third transistors.

9. The driving method according to claim 8, wherein the third period is an emission period and the light-emitting element emits light.

10. The driving method according to claim 7, wherein the first period is an initialization period.

11. The driving method according to claim 7, wherein the second period is a writing and threshold compensation period.

12. The driving method according to claim 7, wherein the first transistor, the second transistors, the third transistors, the fourth transistors, the fifth transistor, and the sixth transistor are transistors with the same polarity.

13. The display device according to claim 7, wherein the first transistor, the second transistors, the third transistors, the fourth transistors, the fifth transistor, and the sixth transistor are P-channel transistors.

* * * * *